United States Patent [19]

Russell

[11] Patent Number: 4,842,563

[45] Date of Patent: Jun. 27, 1989

[54] INFLATABLE BALL WITH SWINGABLE VARIABLE INTERNAL WEIGHT

[75] Inventor: Gordon K. Russell, Islington, Canada

[73] Assignee: Pressers International Products Inc., Mississauga, Canada

[21] Appl. No.: 175,979

[22] Filed: Apr. 1, 1988

[30] Foreign Application Priority Data

Mar. 30, 1988 [CA] Canada ..... 562984

[51] Int. Cl.[4] ..... A63H 3/06; A63H 17/00; A63B 37/00; A63B 39/00

[52] U.S. Cl. ..... 446/221; 446/437; 273/58 BA; 273/58 F

[58] Field of Search ..... 446/220, 221, 222, 224, 446/225, 437; 273/58 B, 58 BA, 58 F, 65 C, 65 D, 65 EC; 52/2 J, 2 H

[56] References Cited

U.S. PATENT DOCUMENTS

| | | | |
|---|---|---|---|
| 495,863 | 4/1893 | Whitzel | 273/58 E |
| 1,595,441 | 8/1926 | Zenger | 273/58 E |
| 2,387,433 | 10/1945 | Fenton | 273/65 D |
| 2,505,526 | 4/1950 | Costea | 446/187 |
| 2,625,770 | 1/1953 | Steen | 446/221 |
| 2,635,387 | 4/1953 | Anderson | 446/221 |
| 2,927,383 | 3/1960 | Longino | 446/221 X |
| 3,655,197 | 4/1972 | Milbaum | 273/138 R |
| 4,223,474 | 9/1980 | Strauss | 446/221 |
| 4,655,722 | 4/1987 | Baron et al. | 446/226 |

FOREIGN PATENT DOCUMENTS

| | | | |
|---|---|---|---|
| 351282 | 7/1935 | Canada . | |
| 1159744 | 1/1984 | Canada . | |
| 558123 | 8/1932 | Fed. Rep. of Germany . | |
| 829109 | 1/1952 | Fed. Rep. of Germany . | |
| 704632 | 12/1979 | U.S.S.R. . | |
| 893680 | 4/1962 | United Kingdom | 446/221 |
| 1367930 | 9/1974 | United Kingdom | 273/65 R |

*Primary Examiner*—Mickey Yu
*Assistant Examiner*—D. Neal Muir
*Attorney, Agent, or Firm*—Rogers, Bereskin & Parr

[57] ABSTRACT

An inflatable ball is disclosed capable of having eccentric flight and bounce characteristics. The inflatable ball has an outer inflatable chamber having a first sealable orifice and an outer skin. An inner fillable chamber having a second sealable orifice and an integral inner skin is also provided. The second sealable orifice is in the outer skin of the outer inflatable chamber. The inner fillable chamber is substantially smaller than the outer inflatable chamber and is located within the outer inflatable chamber generally adjacent the outer skin thereof. The inner fillable chamber is attached to the outer skin at the second sealable orifice. In the preferred embodiment the ball is spherical and the first sealable orifice is diametrically opposed to the second sealable orifice. The second sealable orifice may be provided with locking ridges to secure a plug therein.

9 Claims, 2 Drawing Sheets

INFLATABLE BALL WITH SWINGABLE VARIABLE INTERNAL WEIGHT

FIELD OF THE INVENTION

This invention relates to a ball, and in particular to an inflatable ball of the type that is used as a toy, for recreational purposes. This particular invention relates to an inflatable ball that is capable of having eccentric and unpredictable flight characteristics to enhance the excitement of playing with the ball.

BACKGROUND OF THE INVENTION

Balls, and in particular inflatable balls, are known and have been used extensively as a toy for the playing of various games, such as catch, soccer, volleyball and the like. Such balls are typically constructed in such a manner that their bounce and flight characteristics are those of a perfectly symmetrical sphere; actions and reactions involving such balls are predictable.

However, in order to increase the excitement and pleasure of various such ball games, attempts have been made in the past to develop balls that have eccentric and unpredictable flight and bounce characteristics. For example, in CCCP patent no. 704,632 dated 25.12.79 entitled PLAYBALL, there is disclosed a ball which has two chambers, a main and additional chamber, the latter containing a weight to create a rapid play situation variation when the ball is in use.

Essentially, the ball of patent 704,632, is one having an outer cover, surrounding the two adjacent chambers. The main chamber is relatively larger than the other chamber. In the smaller chamber a weight is attached by a rubber plate to the inside surface of the smaller chamber, adjacent the larger chamber. Each of the main and smaller chambers may be inflated by separate nipples which extend through the outer cover.

Another ball is disclosed in German patent No. 829,109 dated Jan. 1, 1952, entitled AIR FILLED THIN WALLED GAME BALL which suggests suspending a weight, by means of three chords or tapes inside of an air filled ball. In this device there is only one inflatable chamber. The patent suggests that the weight can be eccentrically suspended in the chamber, so there is no control over the bounce (ie the bounce is unpredictable).

However, there are a number of undesirable limitations associated with each of the two discussed balls. In each case, the weight is fixed inside the ball, and is not removable without destroying the ball. In other words, such balls can only be used in the eccentric bounce and flight modes. Further, the ball of patent No. 704,632 requires two inner chambers, and an outer covering, as well as the weight and rubber securing flap for the weight. This is a large number of components which makes the ball awkward and expensive to manufacture. Also, the construction of the ball of German patent No. 829,109 is hazardous, as the attachment of the tapes or chords to the inner surface of the ball will create points of high stress when the ball is in use, increasing the likelihood that the ball would tear at such points and subsequently deflate.

What is desired, is a ball which is simple and inexpensive to manufacture, and which can be used in a regular way, as an ordinary playing ball, or if desired as an eccentrically weighted ball having unpredictable bounce and flight characteristics. What is also desired, is a ball having a secure construction, which will stand up to the rigours of hardy play. Such a ball would preferably provide for a limited degree of freedom for any eccentric weighting means, to further add to the unpredictable and exciting flight and bounce characteristics.

BRIEF SUMMARY OF THE INVENTION

According to the present invention there is disclosed an inflatable ball comprising an outer inflatable chamber having a first resealable orifice, an outer skin, and a first center of volume, and an inner fillable chamber having a second resealable orifice, the second sealable orifice being in said outer skin of said outer inflatable chamber, the inner fillable chamber being substantially smaller than the outer inflatable chamber and being contained therein, the inner fillable chamber having a second center of volume displaced from said first center of volume of said outer inflatable chamber, the inner fillable chamber having a body portion and a neck portion, the neck portion extending between the body portion and the second sealable orifice and being attached to the outer inflatable chamber at said second sealable orifice, said neck portion being the only connection between said inner and outer chambers and being a hollow flexible tube for permitting said inner fillable chamber to swing back and forth within said outer inflatable chamber about said second sealable orifice when said ball is in use, said outer inflatable chamber being inflated with air, said inner fillable chamber containing a selected amount of a medium much denser than air, the amount of said medium in said inner chamber being adjustable through said second orifice, whereby said ball has eccentric and unpredictable flight characteristics.

BRIEF DESCRIPTION OF THE DRAWINGS

Referring to FIG. 1, there is shown an inflatable ball according to the present invention and indicated generally at 10. The inflatable ball 10 is formed from an outer inflatable chamber 14 comprising a first sealable orifice 16 and an outer skin 18. An inner fillable chamber 20 is also shown having a second sealable orifice 22. The second sealable orifice 22 is located in the outer skin 18 of the outer inflatable chamber 14.

Figure 1:
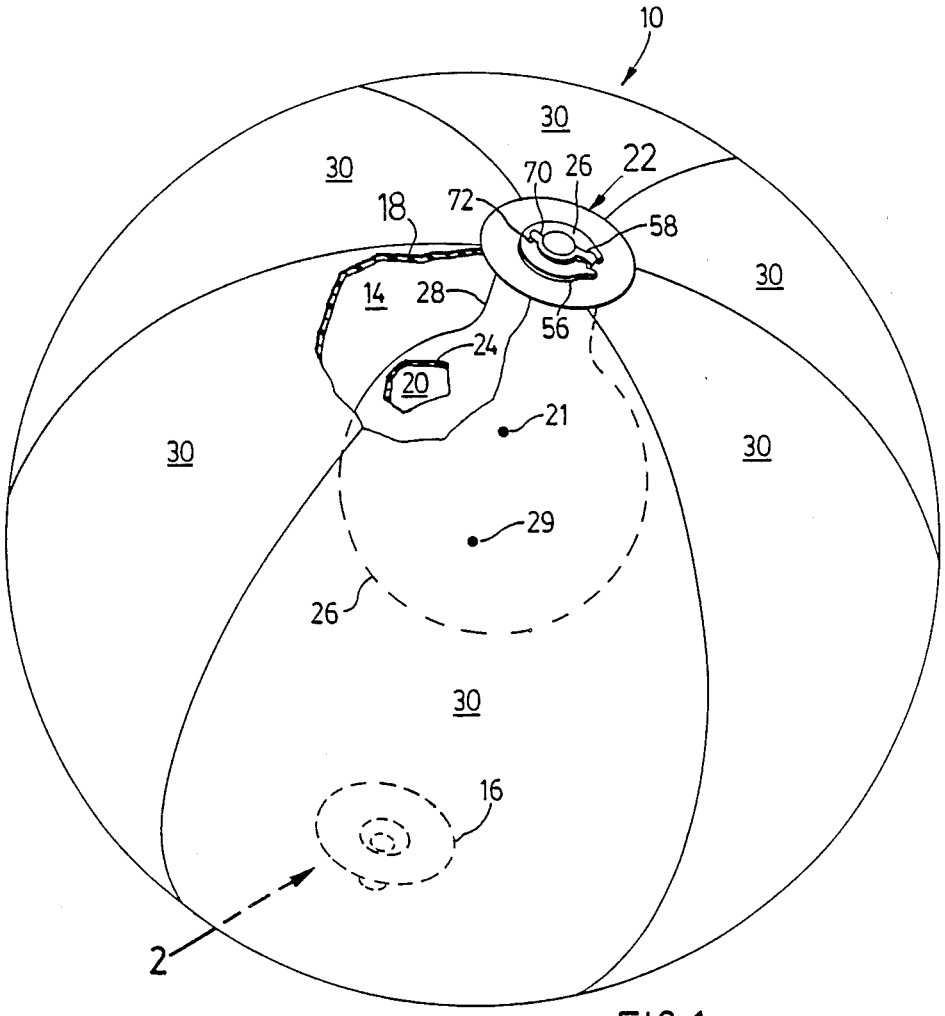
FIG. 1 is an isometric view of an inflatable ball according to the present invention.

As is apparent from FIG. 1, the inner fillable chamber 20 is substantially smaller than the outer inflatable chamber 14 and is contained therein. The inner fillable chamber 20 is located generally adjacent the outer skin 18 of the outer inflatable chamber 14 and is attached to the outer skin 14 at the second sealable orifice 22. The outer skin 18 of the outer inflatable chamber 12 is integrally formed, with the exception of the first and second sealable orifices 16, 22. Similarly the inner fillable chamber 20 consists of an integral inner skin 24. The inner fillable chamber 20 includes a bulbous body portion 26 and a neck portion 28. The neck portion extends between the bulbous body portion 26 and the second sealable orifice 22.

In the preferred embodiment, as depicted in FIG. 1, the outer inflatable chamber 18 is generally spherical, and has a first center of volume, indicated at 29. The inner fillable chamber 20, may be of any shape, although for ease of construction the bulbous body portion 26 with the neck portion 28 is preferred. The inner fillable chamber 20 has a second center of volume 21, as shown. As will be appreciated from FIG. 1, the first center of volume 29 is distant from the second center of volume 21; in other words, the inner fillable chamber 20 is not co-centric with the outer inflatable chamber 18.

Also, in the preferred embodiment, the first sealable orifice 16 is located diametrically opposite the second sealable orifie 22. It will be appreciated by those skilled in the art that it is not necessary to locate the first and second sealable orifices 16, 22 in this manner, but it is preferrable, for the reasons described below. The outer skin 18 of the inflatable ball 10 is formed from a plurality of panels, indicated as 30, which are fastened along each side edge 31 of adjacent panels 30 to form the generally spherical outer inflatable chamber 14. The side edges preferably follow great circles which pass through poles centered on first and second sealable orifices 16, 22. The panels can be fastened by any suitable means such as thermal welding.

It has been found that 8 millimeter thick polyvinyl plastic is appropriate for the outer skin 18. This guage of plastic is also suitable for the integral inner skin 24 of inner fillable chamber 20. This type of plastic is suitable because it is soft and flexible, as well as being slightly elastic. However, it will be appreciated that the elastic properties of the inner skin 24 cannot be such as to allow the inner skin 24 to expand to fill the outer inflatable chamber 12, because this would cause the first center of volume 29 to become co-centric with the second center of volume 21, which is undesirable.

Figure 2:
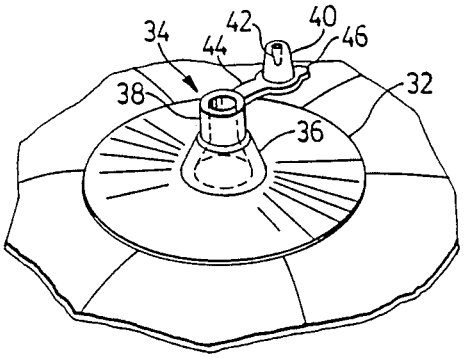
FIG. 2 is a view in the direction of arrow 2 of a portion of the ball of FIG. 1.

Referring to FIG. 2, a close up of the first sealable orifice 16 is shown. As shown, there is an outer reinforcing plate 32 which has a valve structure 34 located at its middle. The valve structure includes a generally conical base 36 and a first tubular portion 38. A first plug 40 is dimensioned to be snuggly received within the inner diameter of the first tubular portion 38. To assist in the fit, the first plug 40 may include a hollowed out channel 42. The first plug 40 may also be attached the valve structure by a retaining flap 44. A lifting extension 46 of the retaining flap 44 provides an easy gripping surface whereby the first plug 40 can be removed frm the first tubular portion 38. The outer reinforcing plate 32 and the valve structure 34 are centered over the joined points of the panels 30. The outer reinforcing plate 32 therefore provides, in addition to a base for the valve structure 34, a reinforcement of the closely spaced joints converging at the location of the valve structure 34 of the panels 30. The outer reinforcing plate can be attached to the outer skin 18 in any suitable manner such as gluing or thermal welding.

It will be appreciated that upon insertion of the plug 40 into the tubular portion 38, an airtight seal will be formed. However, to prevent the plug 40 from being accidentally removed, during play, the valve structure can be pushed into the ball. This is accomplished by causing the conical base 36 to invert. This results in the valve structure 34 being substantially flush with the outer skin 18 of the ball 10.

Figure 3:
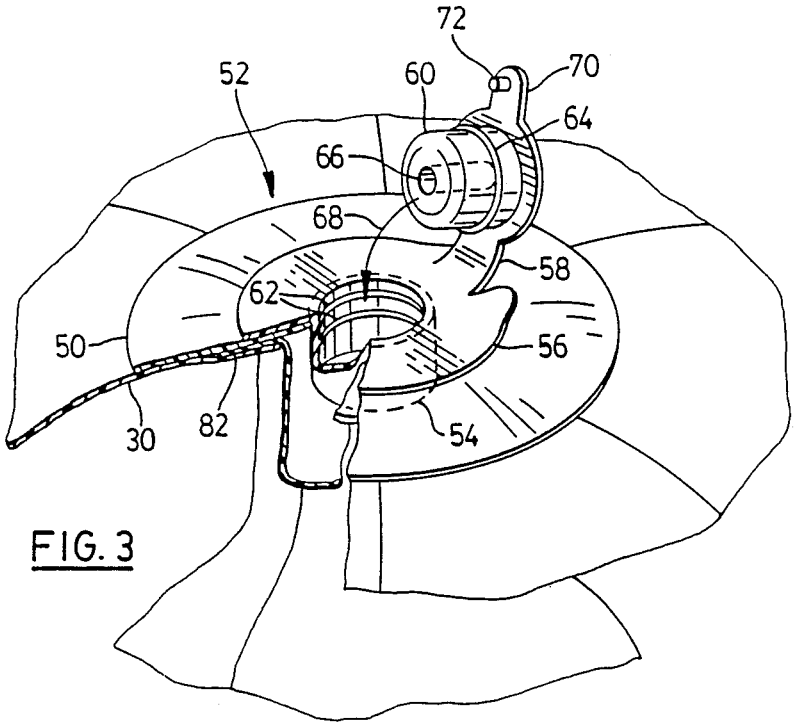
FIG. 3 is an enlarged view in part section of another portion of the ball of FIG. 1 showing an outer inflatable chamber and an inner fillable chamber.

Turning to FIG. 3 there is shown a close up of the second sealable orifice 22 in part section. Again, an outer reinforcing plate 50 is provided for a valve structure 52. However, the valve structure 52 is somewhat differently configured than the valve structure 34.

As shown in FIG. 3, the valve structure 52 includes an inwardly projecting second tubular portion 54 having an outer flange 56 which lies adjacent to the reinforcing plate 50. A retaining flap 58 is formed in the flange 56 to which is attached a second plug 60. The second plug 60 is generally cylindrical and is designed to snuggly fit within the second tubular portion 54.

Located on the inner surface of second tubular portion 54 are inwardly projecting ridges 62. Located on the second plug 60 is an outwardly projecting ridge 64. The second plug 60 may also have a hollow channel 66 formed therein to assist in a snug fit between the plug 60 and the tubular portion 54. When it is desired to seal the second sealable orifice 22, the second plug 60 is inserted into the second tubular portion 54 in the manner indicated by arrow 68. The ridge 64 passes by one or both ridges 62 thereby securely locking the second plug 60 in place. The mating locking ridges 62, 64 form a means for locking the second plug 60 securely within the second tubular portion 54.

Also shown in FIG. 3 is a lifting extension 70 having a tab 72. Upon insertion of the second plug 60 fully into the second tubular portion 54, the retaining flap 58 rests against the flange 56 as shown in FIG. 1. To enable the second plug 60 to be easily removed from the second tubular portion 54, the tab 72 is provided so that the lifting extension 70 is spaced apart somewhat from the flange 56. It will be appreciated by those skilled in the art that the components of the valve structure 52 can be integrally formed from a mouldable plastic. The mouldable plastic is preferrably flexible, but has a sufficient memory to accomplish the locking described above.

Figure 4:
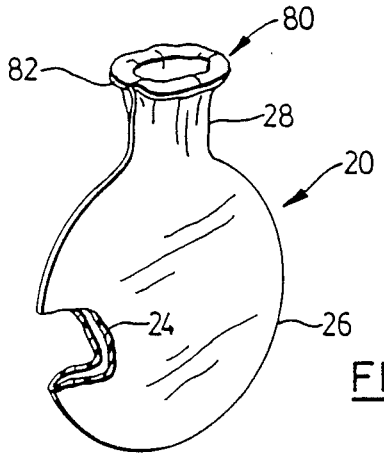
FIG. 4 is a view showing the inner fillable chamber in more detail.

As shown in FIG. 4, the inner fillable chamber 20 includes a flared portion 80 attached to the neck portion 28. Flared top portion 80 includes generally circular lips 82. The inner fillable chamber may be a flat formed member, which expands to a more rounded shape upon being filled with a denser medium, as described below. It may be moulded in one piece or it may be formed from a number of pieces, attached together to form the integral skin 24.

Referring back to FIG. 3, the connection of the second sealable orifice 22 can now be understood. The outer skin 18 forms the inner most layer as indicated in FIG. 3. The next outer layer is the lips 82 of the flared top 80 of the inner fillable chamber 20. The next outer layer is the reinforcing plate 50. The final outer layer is the flange 56 of the valve structure 52. All of these layers can be secured together by appropriate bonding, such as by gluing or thermal welding or the like. It will be appreciated by those skilled in the art that the location of the second sealable orifice strengthens the confluence of the points of the panels 30 which form the outer skin 18. Therefore, it will now be appreciated why it is preferrable to locate the sealable orifices 16, 22 diametrically opposite, namely, to reinforce the two weakest portions of the inflatable ball 10, where the points of the panels 30 meet.

It can now be appreciated how the inflatable ball 10 of the present invention may be used. In one mode, the inflatable ball 10 operates as an ordinary inflatable ball. The inflatable ball 10 would be inflated by blowing through the first sealable orifice 16. Provided the second sealable orifice 22 was open, the pressure inside the outer skin 18, created by inflating the ball 10, would cause any air or other material in the inner inflatable chamber 20 to be expelled out of the second sealable orifice 22. When the inflatable ball was inflated to the desired pressure, the first sealable orifice 16 can be sealed, in the manner described above by inserting the first plug 40 into first tubular portion 38, then the second sealable orifice 22 can be sealed by inserting the second plug 60 into second tubular portion 54, and the ball is ready for use. Because the inner fillable chamber 20 has been emptied, the ball acts as an ordinary ball having predictable flight and bounce characteristics.

Alternatively, in another mode, the inflatable ball 10 can be used as a ball having exciting and eccentric bounce and flight characteristics. In this mode, one would need to start with ambient pressure in the outer inflatable chamber 12. This would be accomplished by removing the first plug 40 from the first tubular portion 38 of the first sealable orifice 16. Then, the second sealable orifice 22 can be opened, by pulling on the lifting extension 70 to pull second plug 60 out of the second tubular portion 54. Then, the inner fillable chamber 20 could be filled with any desired medium having a density greater than air. Examples of such media would be water, sand, or even dirt, depending upon what was readily available. However, water would be preferrable. Upon filling the inner fillable chamber 20 with for example water the second sealable orifice 22 can then be sealed in the manner described above. Then, the outer inflatable chamber 12 can be inflated and the first sealable orifice sealed.

In this mode, the ball 10 will have eccentric and unpredictable flight characteristics. It will tend to gyrate wildly about its centre of gravity, which will be located relatively near the second center of volume 21 by reason of the denser medium filling the inner fillable chamber 20. In this manner, the center of gravity of the ball 10 will not be at the first center of volume 29, which will cause the ball 10 to gyrate eccentrically when in use. In addition, the flexible neck portion 28 of the inner fillable chamber 20 allows the centre of gravity to gyrate somewhat even in the ball 10. This will further add to the eccentric flight characteristics. In this manner an unpredictable and interesting ball can be used to play any traditional games such as soccer, volleyball and the like.

It will now be appreciated why the means for locking the second sealable orifice 22, comprising the locking ridges 62, 64 is provided. Because the inner fillable chamber 22 is filled with a relatively denser medium than air, there will be greater stresses on the valve structure 52. Further, in the case of the inner fillable chamber being filled with an incompressible fluid, such as water, a blow to the inner fillable chamber, as may be expected to happen when the ball is in use, will create considerable pressure outwardly on the plug 60. The locking means is to inhibit any unwanted unsealing of the plug 60 from the tubular portion 62.

It has been found that satisfactory results are obtained where the volume of the inner fillable chamber 20 is 8 fluid ounces for a 20" diameter ball 10. Also, a 10 fluid ounce inner fillable chamber 20 yields satisfactory results for a 24" diameter ball 10. Of course, variations in the volume proportion can be made, providing that the inner fillable chamber 20 does not become so large or so small as to eliminate the variable and eccentric bounce and flight characteristics of the ball 10.

It will be of course be appreciated that the preceding description relates to a particular preferred embodiment of the invention and that many modifications are possible within the broad scope of the invention. Some of those modifications have been indicated above and others will be apparent to a person skilled in the art. For example, while the invention is defined in reference to a ball having two valves diametrically opposed, there is no limitation to this particular configuration. For example, provided adequate reinforcing was providing, the valves could be adjacent one another or in any other position on the surface of the outer skin 18.

I claim:

1. An inflatable ball comprising an outer inflatable chamber having a first resealable orifice, an outer skin, and a first center of volume, and an inner fillable chamber having a second resealable orifice, the second sealable orifice being in said outer skin of said outer inflatable chamber, the inner fillable chamber being substantially smaller than the outer inflatable chamber and being contained therein, the inner fillable chamber having a second center of volume displaced from said first center of volume of said outer inflatable chamber, the inner fillable chamber having a body portion and a neck portion, the neck portion extending between the body portion and the second sealable orifice and being attached to the outer inflatable chamber at said second sealable orifice, said neck portion being the only connection between said inner and outer chambers and being a hollow flexible tube for permitting said inner fillable chamber to swing back and forth within said outer inflatable chamber about said second sealable orifice when said ball is in use, said outer inflatable chamber being inflated with air, said inner fillable chamber containing a selected amount of medium much denser than air, the amount of said medium in said inner chamber being adjustable through said second orifice, whereby said ball has eccentric and unpredictable flight characteristics.

2. The inflatable ball of claim 1 wherein said outer inflatable chamber is generally spherical.

3. The inflatable ball of claim 1 wherein said outer inflatable chamber is generally spherical, and said first sealable orifice is located diametrically opposite said second sealable orifice.

4. The inflatable ball of claim 3, wherein said outer skin of said outer inflatable chamber is formed from a plurality of panels, formed from polyvinyl plastic, each of said panels being fastened along their respective side edges to adjacent panels to form said generally spherical outer inflatable chamber.

5. The inflatable ball of claim 1 further including a first plug for sealing said first sealable orifice and a second plug for sealing said second sealable orifice.

6. The inflatable ball of claim 5, wherein each of said first and second plugs includes a lifting extension and a retaining flap and said second plug further includes a locking means.

7. The inflatable ball of claim 1, further including a first plug for sealing said first sealable orifice, and a second plug for sealing said second sealable orifice, each of said plugs including a lifting extension and a retaining flap, and said second plug including a locking means comprising at least one outwardly projecting locking ridge.

8. The inflatable ball of claim 7 wherein said first and second sealable orifices are circular, and have tubular portions for snuggly receiving said plugs and said second sealable orifice has at least one inwardly projecting locking ridge in said tubular portion for engaging said outwardly projecting locking ridge of said second plug.

9. The inflatable ball of claim 1 wherein said outer inflatable chamber and said inner fillable chamber are both formed of thin flexible plastic material.

* * * * *